US012673360B2

(12) United States Patent
Park et al.

(10) Patent No.: US 12,673,360 B2
(45) Date of Patent: Jul. 7, 2026

(54) MELT TRANSPORTATION APPARATUS AND MELT TRANSPORTATION METHOD

(71) Applicant: POSCO CO., LTD, Pohang-si (KR)

(72) Inventors: Sang Hyun Park, Pohang-si (KR); Jong Woo You, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 171 days.

(21) Appl. No.: 18/575,516

(22) PCT Filed: Jul. 1, 2022

(86) PCT No.: PCT/KR2022/009552
§ 371 (c)(1),
(2) Date: Dec. 29, 2023

(87) PCT Pub. No.: WO2023/277661
PCT Pub. Date: Jan. 5, 2023

(65) Prior Publication Data

US 2024/0307953 A1 Sep. 19, 2024

(30) Foreign Application Priority Data

Jul. 2, 2021 (KR) ..... 10-2021-0087261

(51) Int. Cl.
*B22D 41/26* (2006.01)
*B22D 41/12* (2006.01)

(52) U.S. Cl.
CPC ..... *B22D 41/26* (2013.01); *B22D 41/12* (2013.01)

(58) Field of Classification Search
CPC ..... B22D 41/26; B22D 41/12; B22D 41/14; B22D 41/24; B22D 11/10; F27D 2001/1825; F27D 1/1816
See application file for complete search history.

(56) References Cited

U.S. PATENT DOCUMENTS 4,062,385 A * 12/1977 Katusha ..... G03G 15/0882 222/DIG. 1
4,130,149 A * 12/1978 Hausam ..... A47G 19/34 141/358

(Continued)

FOREIGN PATENT DOCUMENTS

CN 101600655 A * 12/2009 ..... C02F 1/003
CN 203343430 U 12/2013

(Continued)

OTHER PUBLICATIONS

Extended European Search Report issued Jun. 5, 2025 in Application No. 22833714.3.

(Continued)

*Primary Examiner* — Bob Zadeh
(74) *Attorney, Agent, or Firm* — Sughrue Mion, PLLC

(57) ABSTRACT

A melt transportation apparatus according to an embodiment of the present invention comprises: a container having an internal space in which melt can be accommodated and an opening through which the melt can be input/output; a cover part which has a cover member capable of closing the opening and which is positioned at the top of the container so as to be movable forward/backward with respect to the opening; and a support part having a rotary body, which can move forward/backward with respect to the cover part at the bottom of the cover part so that the support part can be in contact with the cover part. Therefore, according to embodiments of the present invention, the opening of the container can be easily opened/closed in a limited space. In addition, when the opening is opened/closed by moving the cover part, sagging or tilting of the cover part can be prevented. Thus, the cover part can be easily moved and exposure of at least a portion of the opening to the outside can be pre- (Continued)

vented. Therefore, a decrease in the temperature of the melt inside the container can be prevented or suppressed.

13 Claims, 7 Drawing Sheets

(56) References Cited

U.S. PATENT DOCUMENTS

| | | | | | |
|---|---|---|---|---|---|
| 4,739,711 | A * | 4/1988 | Mair | C21C 1/06 105/377.01 |
| 2024/0307953 | A1 * | 9/2024 | Park | F27D 1/1816 |

FOREIGN PATENT DOCUMENTS

| | | | | | |
|---|---|---|---|---|---|
| CN | 105397078 | A | * | 3/2016 | B22D 41/12 |
| CN | 106041043 | A | * | 10/2016 | B22D 41/12 |
| CN | 208245809 | U | * | 12/2018 | |
| CN | 212225177 | U | * | 12/2020 | |
| CN | 112828272 | A | * | 5/2021 | B22D 41/12 |
| JP | 56-123852 | U | | 2/1980 | |
| JP | 57-87044 | U | | 11/1980 | |
| JP | 59-17751 | U | | 2/1984 | |
| JP | 60-136859 | U | | 9/1985 | |
| KR | 10-0701394 | B1 | | 3/2007 | |
| KR | 10-2010-0013551 | A | | 2/2010 | |
| KR | 10-1013176 | B1 | | 2/2011 | |
| KR | 10-2011-0019976 | A | | 3/2011 | |
| KR | 10-1113283 | B1 | | 3/2012 | |
| KR | 10-1629810 | B1 | | 6/2016 | |

OTHER PUBLICATIONS

Japanese Office Action dated Dec. 24, 2024 in Application No. 2023-580861.

English Translation of Written Opinion for the International Searching Authority Dated Sep. 30, 2022 in Application No. PCT/KR2022/009552.

International Search Report for PCT/KR2022/009552, dated Sep. 30, 2022.

Written Opinion for PCT/KR2022/009552, dated Sep. 30, 2022.

Communication dated Mar. 18, 2026 issued by the State Intellectual Property Office of the P.R.China in application No. 202280046879.6.

* cited by examiner

MELT TRANSPORTATION APPARATUS AND MELT TRANSPORTATION METHOD

CROSS REFERENCE TO RELATED APPLICATIONS

This application is a National Stage of International Application No. PCT/KR2022/009552 filed Jul. 1, 2022, claiming priority based on Korean Patent Application No. 10-2021-0087261 filed Jul. 2, 2021, the entire disclosures of which are incorporated herein by reference.

TECHNICAL FIELD

The present disclosure relates to a molten material transport apparatus and a molten material transport method, and more particularly, to a molten material transport apparatus capable of easily opening and closing a container in which a molten material is accommodated and a molten material transport method.

BACKGROUND ART

Molten iron drawn from a blast furnace is charged into a container of a torpedo car Thereafter, torpedo car is moved to a working place in which impurities of the molten iron are removed, i.e., a steel manufacturing plant. Here, an opening is closed by using a cover to prevent a temperature of the molten iron from dropping while the torpedo car is moving to the steel manufacturing plant.

On the other hand, a sub-material such as a heating agent and a desulfurization agent is input into the molten iron a plurality of times while moving the torpedo car to the steel manufacturing plant. Thus, an operation of opening and closing the opening of the torpedo car moving to the steel manufacturing plant needs to be repeated several times.

However, the torpedo car, as a non-powered carrier, does not have a power for moving the cover to open and close the opening. Thus, a device separated from the torpedo car is used to lift or lower the cover to open and close the opening.

However, since many devices are installed along a path along which the torpedo car is moved, a space around the torpedo car is not sufficient. In particular, a space above the torpedo car is extremely narrow. Accordingly, a device for moving the cover is hardly disposed above the torpedo car, and thus, it is difficult to open and close the opening by lifting and lowering the cover. Also, due to this, it is extremely difficult to open and close the opening several times while moving the torpedo car to the steel manufacturing plant.

RELATED ART DOCUMENT (Patent document 1) Korean Patent Registration No. 10-0701394.

DISCLOSURE OF THE INVENTION

Technical Problem

The present disclosure provides a molten material transport apparatus that easily opens and closes a container and a molten material transport method.

The present disclosure provides a molten material transport apparatus that easily opens and closes a container in a limited space and a molten material transport method.

The present disclosure provides a molten material transport apparatus capable of preventing a cover unit that opens and closes a container from being deflected and a molten material transport method.

Technical Solution

In accordance with an exemplary embodiment, a molten material transport apparatus includes: a container having an internal space in which the molten material is accommodated and an opening through which the molten material enters and exits; a cover unit having a cover member configured to close the opening and configured to be moved forward and backward with respect to the opening; and a support unit having a rotating body disposed below the cover unit and moved forward and backward with respect to the cover unit to contact the cover unit.

The molten material transport apparatus may further include a forward and backward driving unit coupled to a lower portion of the cover unit at one side of the container to move the cover unit forward and backward, wherein the support unit is disposed between the forward and backward driving unit and the container and inclined upward so that a distance to the opening gradually decreases in a direction toward the rotating body.

The support unit may include: a support having one end facing the cover unit, which is connected to the rotating body, and being inclined upward so that a distance to the opening gradually decreases in a direction toward the one end; and a support driving source connected to the other end of the support to move the support forward and backward with respect to the cover unit.

The molten material transport apparatus may further include a support height adjustment unit connected with the support unit to lift and lower the support unit The molten material transport apparatus may further include: a lifting and lowering driving unit connected to a lower portion of the forward and backward driving unit to lift and lower the forward and backward driving unit; and first and second housings connected to both ends in a longitudinal direction of the container, respectively, in which the forward and backward driving unit and the lifting and lowering driving unit may be disposed on an upper portion of the first housing, and the support unit and the support height adjustment unit may be disposed on a side portion of the first housing.

The molten material transport apparatus may further include a power supply unit disposed on the first housing to provide power to each of the forward and backward driving unit, the lifting and lowering driving unit, the support unit, and the support height adjustment unit, in which the power supply unit may include a battery.

The molten material transport apparatus may further include a control unit configured to control an operation of each of the forward and backward driving unit, the lifting and lowering driving unit, the support unit, and the support height adjustment unit by wirelessly receiving a command signal input from the outside.

The molten material transport apparatus may further include: a control unit disposed on the first housing to control an operation of each of the forward and backward driving unit, the lifting and lowering driving unit, the support unit, and the support height adjustment unit; and an operation button disposed on the first housing to transmit a command signal to the control unit.

The molten material transport apparatus may further include an operation handle disposed on the first housing to control an operation of each of the forward and backward driving unit, the lifting and lowering driving unit, the support unit, and the support height adjustment unit.

In accordance with another exemplary embodiment, a method for transporting a molten material includes: transporting a molten material transport apparatus in which the molten material is accommodated in a container; and opening and closing an opening of the container, in which the opening and closing of the opening includes: moving a cover unit forward or backward with respect to the opening; and primarily supporting the cover unit that is moved forward or backward at a lower side of the cover unit.

The opening and closing of the opening may include: lifting or lowering the cover unit after the moving of the cover unit forward or backward; and secondarily supporting the cover unit that is lifted or lowered at the lower side of the cover unit.

The primarily supporting and secondarily supporting may include allowing a rotating body disposed below the cover unit to contact the cover unit, and the primarily supporting may include allowing the rotating body to rotate by a force of the cover unit that is moved forward or backward.

The allowing of the rotating body to contact the cover unit may include moving the rotating body forward or backward with respect to the cover unit, and the moving of the rotating body forward or backward with respect to the cover unit may include moving the rotating body forward or backward in an inclined manner so that a distance spaced apart from the opening gradually decreases as a height of the rotating body increases.

The allowing of the rotating body to contact the cover unit may include allowing the rotating body to contact an area except for an area facing the opening when a portion of the cover unit is disposed to face the opening to close the opening.

Each of the moving of the rotating body forward or backward, the primarily supporting and secondarily supporting, and the lifting and lowering may be operated by using electric power.

Each of the moving of the rotating body forward or backward, the primarily supporting and secondarily supporting, and the lifting and lowering may include generating a command signal through a remote controller provided separately from the molten material transport apparatus and connected wirelessly to the cover unit and the rotating body.

Advantageous Effects

In accordance with the exemplary embodiment, the opening of the container may be easily opened and closed in the limited space.

Also, when the opening is opened and closed by moving the cover unit, the deflection or tilting of the cover unit may be prevented. Accordingly, the cover unit may be easily moved, and at least a portion of the opening may be prevented from being exposed to the outside. Thus, the temperature drop of the molten material in the container may be prevented or suppressed.

Also, the opening may be opened and closed without being connected to the external power source, and the opening may be freely opened and closed when necessary.

MODE FOR CARRYING OUT THE INVENTION

Figure 1:
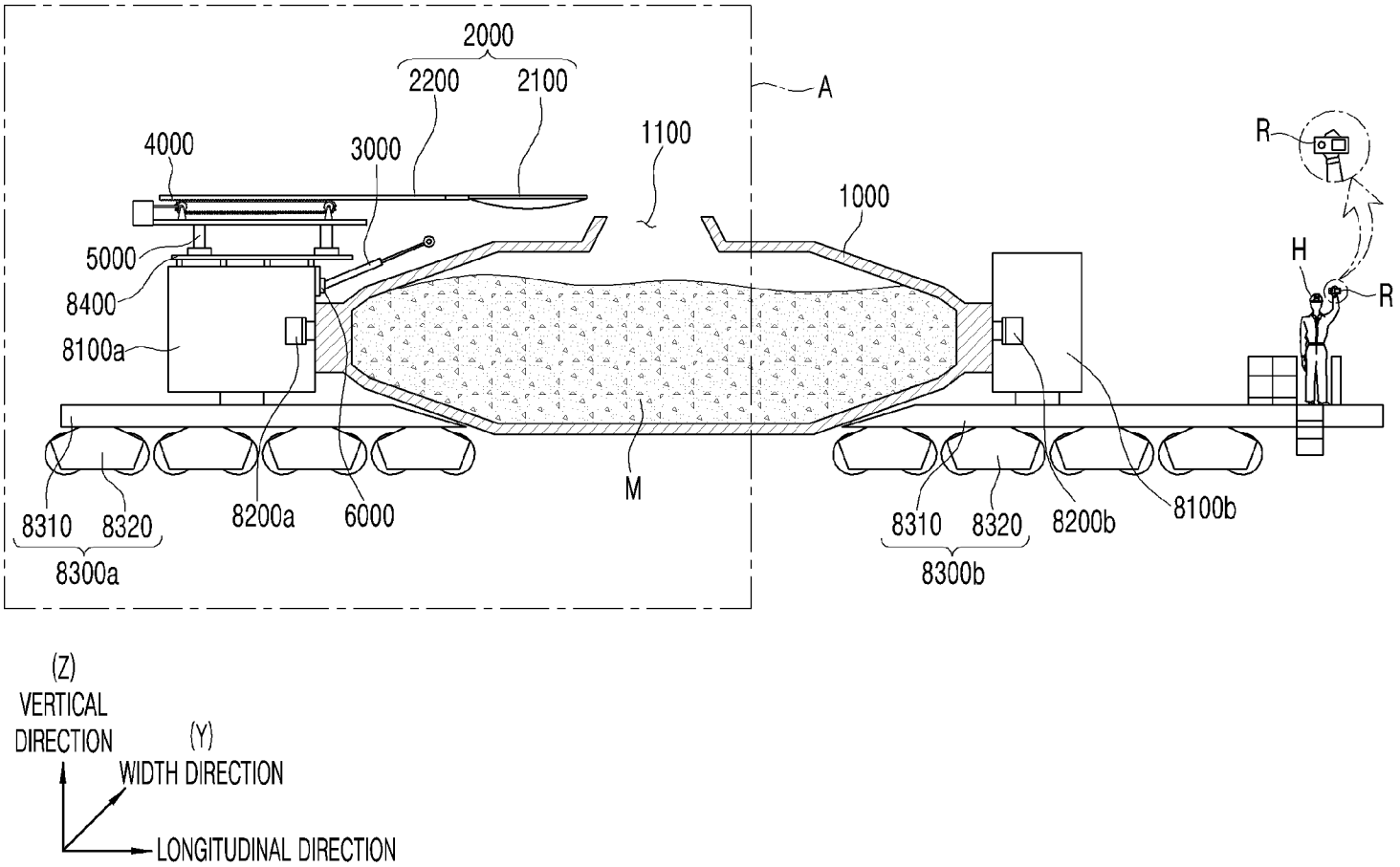
FIG. 1 is a front view illustrating a molten material transport apparatus in accordance with an exemplary embodiment.

Hereinafter, an exemplary embodiment will be described in detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. In the drawings, the dimensions of layers and regions are exaggerated for clarity of illustration. Like reference numerals refer to like elements throughout.

The present disclosure relates to a molten material transport apparatus capable of easily opening and closing an opening defined in a container in which a molten material is accommodated. More particularly, the present disclosure relates to a molten material transport apparatus capable of easily opening and closing an opening in a limited space and preventing a cover unit opening and closing a container from being deflected.

Here, the molten material may be molten iron. Also, the molten material transport apparatus may transport molten iron drawn from a facility that produces the molten iron, such as a blast furnace. More specifically, the molten material transport apparatus may be called as a torpedo car in a field of a steel making technology.

Figure 2:
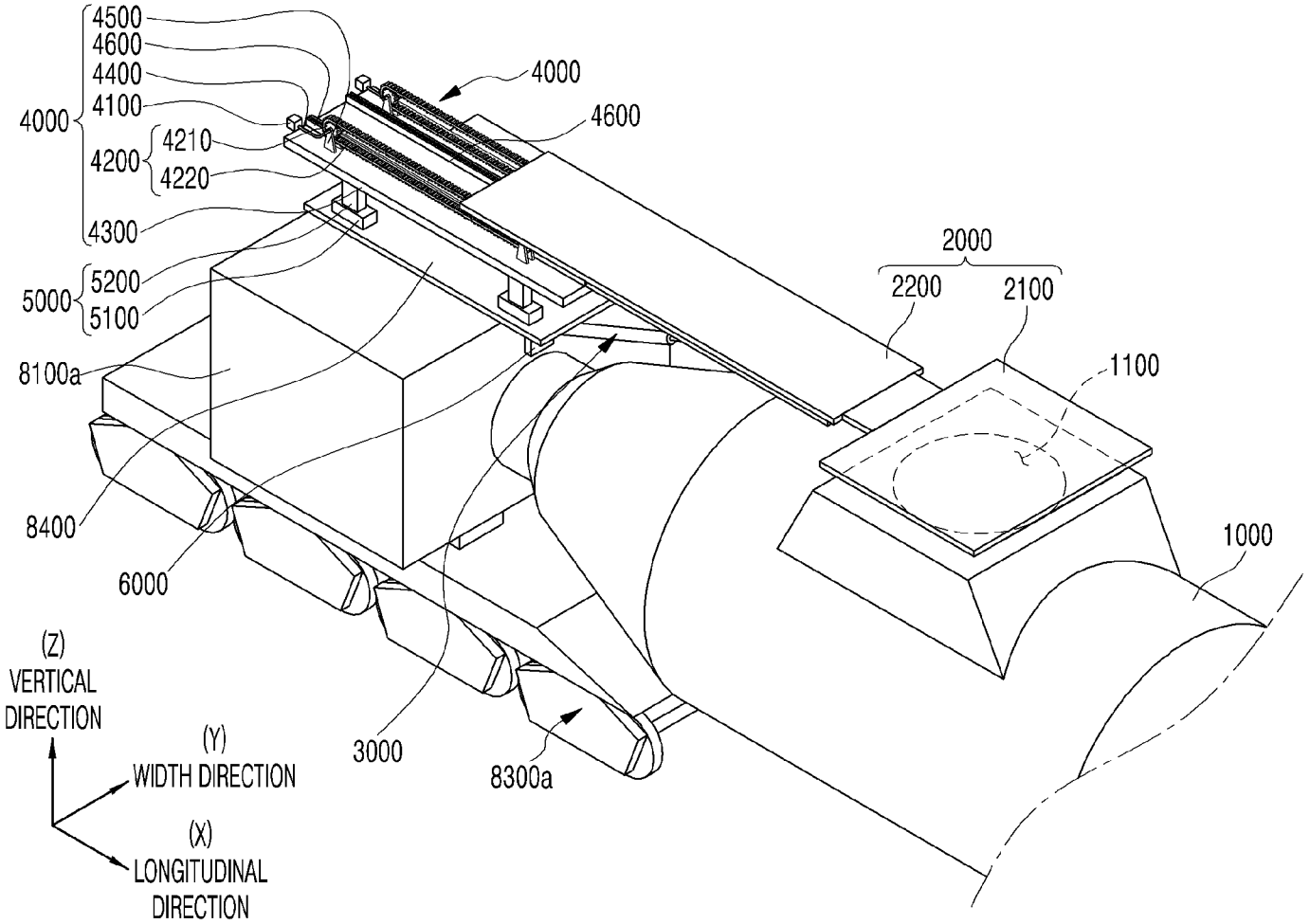
FIG. 2 is an enlarged three-dimensional view illustrating portion 'A' of FIG. 1.
Figure 3:
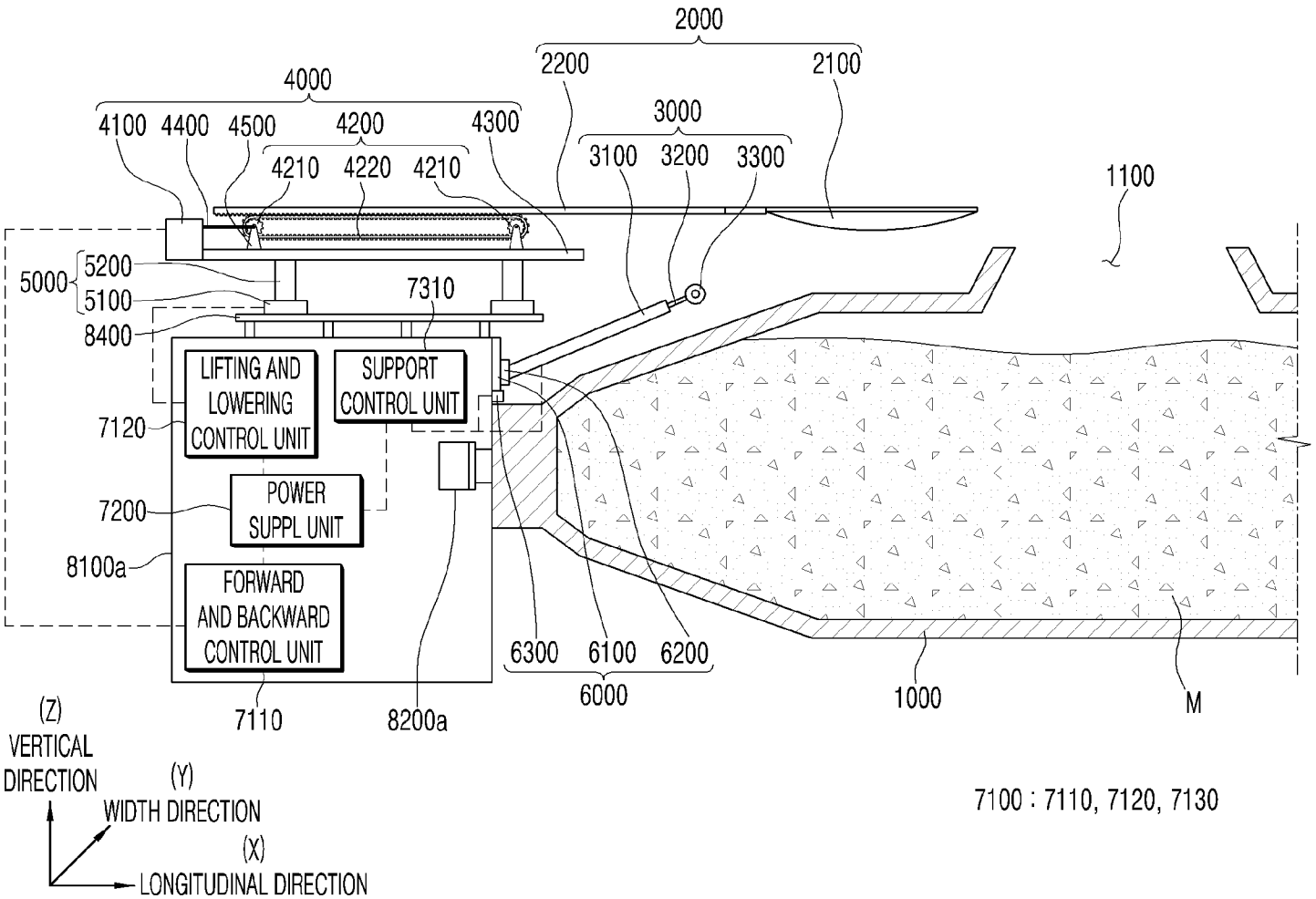
FIG. 3 is a cross-sectional view illustrating a portion of the molten material transport apparatus in accordance with an exemplary embodiment.

FIG. 1 is a front view illustrating a molten material transport apparatus in accordance with an exemplary embodiment. FIG. 2 is an enlarged three-dimensional view illustrating portion 'A' of FIG. 1. FIG. 3 is a cross-sectional view illustrating a portion of the molten material transport apparatus in accordance with an exemplary embodiment;

Referring to FIGS. 1 to 3, the molten material transport apparatus in accordance with an exemplary embodiment includes: a container 1000 having an internal space in which the molten material M is accommodated and an opening 1100 through which the molten material M enters and exits; a cover unit 2000 including a cover member 2100 capable of opening and closing the opening 1100 and disposed above the container 1000 to move forward and backward with respect to the opening 1100; and a support unit 3000 disposed below the cover part 200 and lifting and lowering to support the cover unit 2000 or release a support force.

Also, the molten material transport apparatus includes: a forward and backward driving unit 4000 that moves the cover unit 2000 forward and backward; a lifting and lowering driving unit 5000 that elevates the forward and backward driving unit 4000; and a support height adjustment unit 6000 that elevates the support unit 3000.

Also, the molten material transport apparatus includes: first and second housings 8100*a* and 8100*b* disposed on both sides in a longitudinal direction (X-axis direction) of the container 1000; first and second rotation driving units 8200*a* and 8200*b* connected to both ends in the longitudinal direction of the container 1000 to provide a rotational driving force; first and second moving units 8300*a* and 8300*b* connected to lower portions of the first and second housings 8100*a* and 8100*b*, respectively; and a stand 8400 disposed on the first housing 8100*a* to support the forward and backward driving unit 4000 and the lifting and lowering driving unit 5000.

As illustrated in FIG. 3, the molten material transport apparatus includes: a control unit 7100 disposed in the first housing 8100*a* to control an operation of each of the forward and backward driving unit 4000, the lifting and lowering driving unit 5000, the support unit 3000, and the support height adjustment unit 6000; and a rechargeable battery type power supply unit 7200 disposed in the first housing 8100*a*. Here, the power supply unit 7200 may be a unit that applies power for driving the forward and backward driving unit 4000, the lifting and lowering driving unit 5000, the support unit 3000, and the support height adjustment unit 6000.

The molten material transport apparatus is moved in a state in which the molten material M is accommodated in the container 1000. Here, the molten material transport apparatus is moved in a state in which the opening 1100 of the container 1000 is closed by the cover member 2100. The feature of closing the opening 1100 when moving the molten material transport apparatus is to prevent or suppress a temperature drop of the molten material M.

The container 1000 is a unit for accommodating the molten material M. The container 1000 may be made of a material containing a refractory material to prevent or suppress the temperature drop of the molten material M. The container 1000 may have a shape extending in one direction, and the both ends in the longitudinal direction of the container 1000 may be inserted into the first and second housings 8100*a* and 8100*b* and connected to the first and second rotation driving units 8200*a* and 8200*b*, respectively, as illustrated in FIG. 1. Also, the container 1000 may have the opening 1100 through which the molten material M is charged or discharged. The opening 1100 may be disposed at a central portion in the longitudinal direction of the container 1000.

Each of the first and second housings 8100*a* and 8100*b* may have a box shape having an internal space. Also, the first rotation driving unit 8200*a* connected to one end of the container 1000 may be disposed in the first housing 8100*a*, and the second rotation driving unit 8200*b* connected to the other end of the container 1000 may be disposed in the second housing 8100*b*. As illustrated in FIG. 1, a base 4300, the lifting and lowering driving unit 5000, and the forward and backward driving unit 4000 may be disposed on one of the first and second housings 8100*a* and 8100*b*, e.g., the first housing 8100*a*.

Each of the first and second rotation driving units 8200*a* and 8200*b* is a unit that provides a rotational driving force so that the container 1000 rotates. Each of the first and second rotation driving units 8200*a* and 8200*b* may be a unit that is operated by electric power. As a more specific example, each of the first and second rotation driving units 8200*a* and 8200*b* may be a unit including a motor that is operated by electric power.

The rotation of the container 1000 through the first and second rotation driving units 8200*a* and 8200*b* may be performed when the molten material M in the container 1000 is discharged to the outside. That is, when the container 1000 rotates so that a height of the opening 1100 is lowered by operating the first and second rotation driving units 8200*a* and 8200*b*, the molten material M is discharged to the outside through the opening 1100.

Each of the first and second moving units 8300*a* and 8300*b* is a unit that moves the molten material transport apparatus. Each of the first and second moving units 8300*a* and 8300*b* may be a unit that slides along a rail. That is, each of the first and second moving units 8300*a* and 8300*b* may include a frame 8310 disposed below each of the housings 8100*a* and 8100*b* and a wheel 8320 disposed below the frame 8310 to rotate.

As illustrated in FIG. 1, a space for a worker H to ride may be provided at an upper portion of at least one of the first and second moving units 8300*a* and 8300*b*. For example, as illustrated in FIG. 1, the space for the worker H to ride may be provided at the upper portion of the second moving unit 8300*b*. Thus, the molten material transport apparatus may be moved with the worker H riding thereon.

The worker H may ride on the molten material transport apparatus with a remote controller R capable of wirelessly controlling an operation of at least one of the forward and backward driving unit 4000, the lifting and lowering driving unit 5000, the support unit 3000, and the support height adjustment unit 6000 that will be described later. Thus, the worker H may control the forward and backward driving unit 4000, the lifting and lowering driving unit 5000, the support unit 3000, and the support height adjustment unit 6000 by using the remote controller R. That is, the worker H may control the forward and backward driving unit 4000, the lifting and lowering driving unit 5000, the support unit 3000, and the support height adjustment unit 6000 without getting off from the molten material transport apparatus.

Thus, the worker H may open or close the opening 1100 by operating the remote controller R to move the cover unit 2000 when necessary while the molten material transport apparatus is moved to a final destination. That is, the worker H may control the operation of at least one of the forward and backward driving unit 4000, the lifting and lowering driving unit 5000, the support unit 3000, and the support height adjustment unit 6000 by using the remote controller R to move the cover unit 2000, thereby opening and closing the opening 1100.

Here, a situation in which the opening 1100 needs to be opened while the molten material transport apparatus is moving toward the final destination may be a situation in which the molten material transport apparatus reaches a position for inputting a sub-material. For example, while the molten material transport apparatus is moving to the final destination, the sub-material such as a heating agent and a desulfurization agent. Accordingly, when the molten material transport apparatus arrives at a position at which the heating agent is input (hereinafter, referred to as a heating agent input position) and a position at which the desulfurization agent is input (hereinafter, referred to as a desulfurization agent input position) while the molten material transport apparatus is moving, the opening 1100 needs to be opened for inputting the sub-material.

Thus, when the molten material transport apparatus is moved with the worker H on board and arrives at, e.g., the heating agent input position, the worker H controls the operation of the cover unit 2000 by using the remote controller R to open the opening 1100 closed by the cover member 2100. Thereafter, when the inputting of the sub-materials is completed, the worker H moves the cover member 2100 by using the remote controller R again to close the opening 1100.

Figure 4:
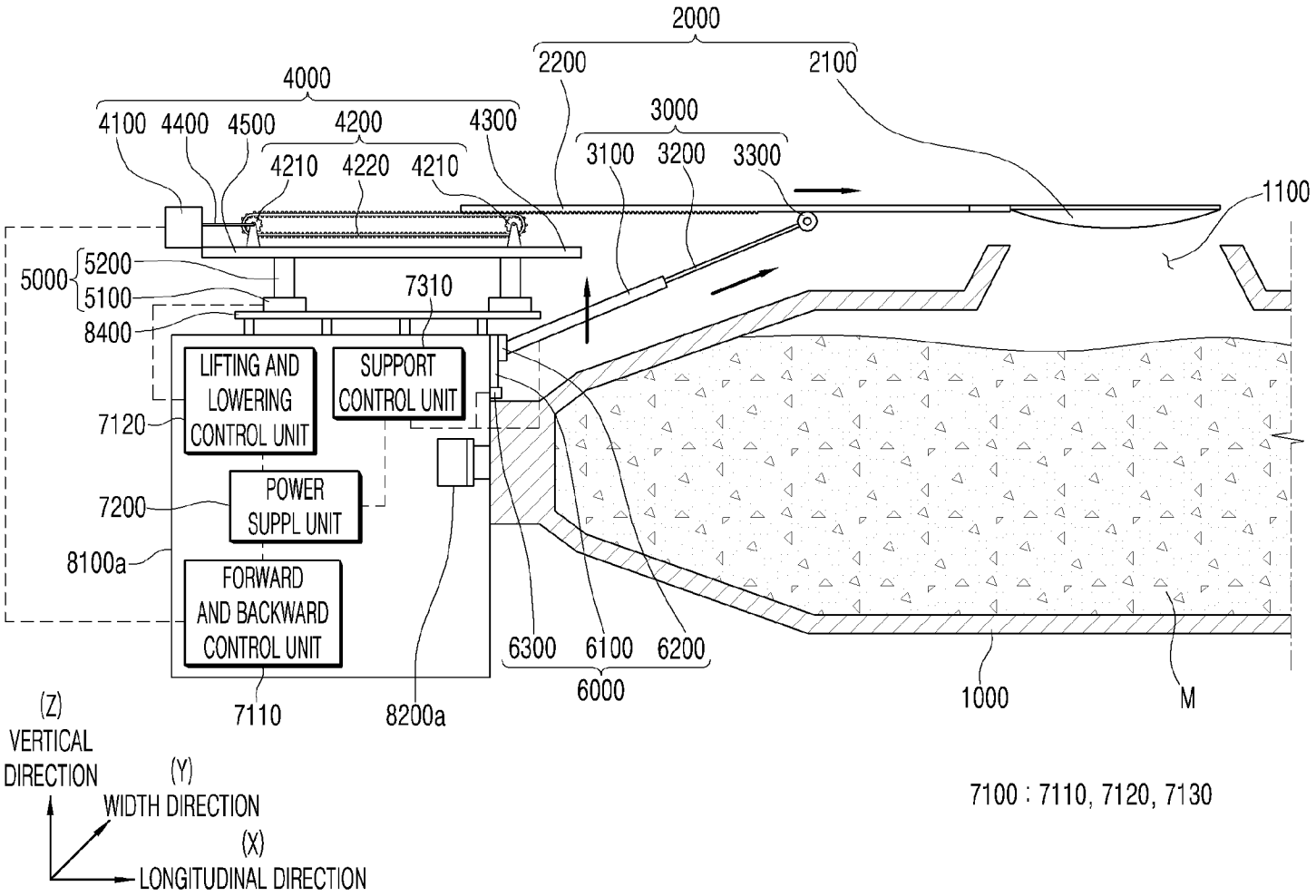
FIGS. 4 to 6 are views for explaining an operation of a cover unit and a support unit of the molten material transport apparatus in accordance with an exemplary embodiment and illustrating a portion of the molten material transport apparatus.
Figure 5:
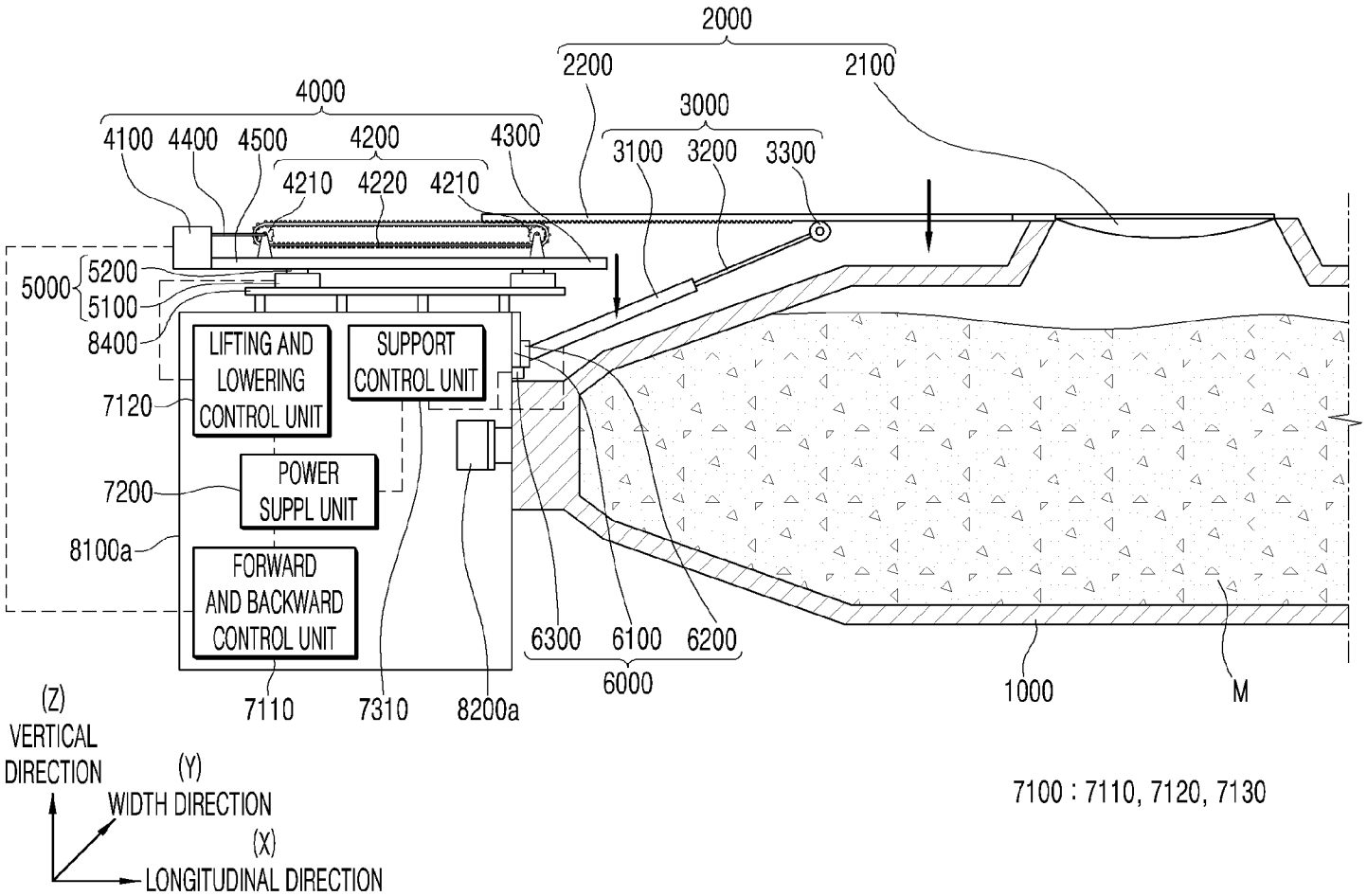
Figure 6:
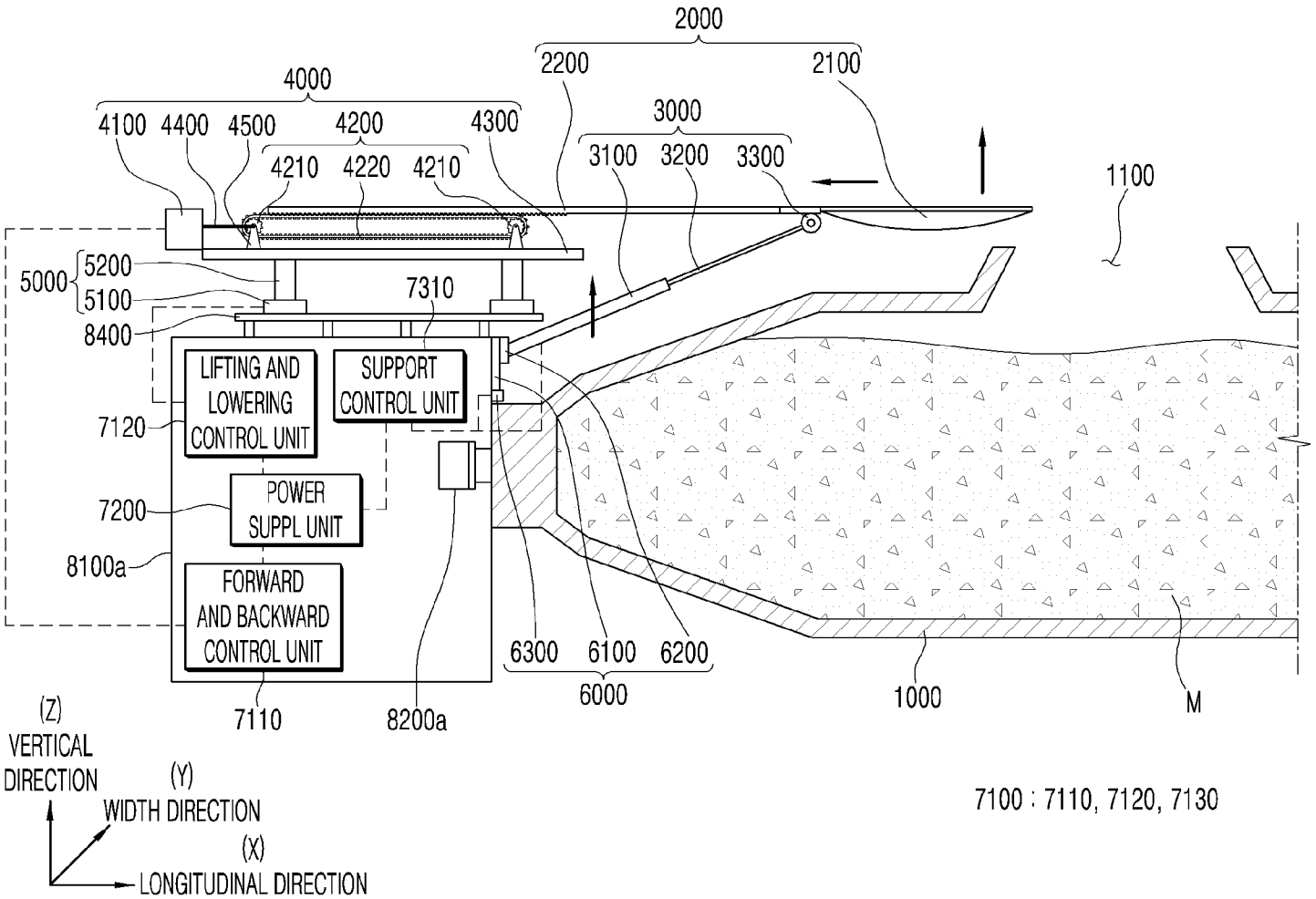

FIGS. 4 to 6 are views for explaining operations of the cover unit and the support unit of the molten material transport apparatus in accordance with an exemplary embodiment and illustrating a portion of the molten material transport apparatus.

Referring to FIGS. 1 to 6, the cover unit 2000 is a unit for closing (covering) or opening the opening 1100 defined in the container 1000. The cover unit 2000 opens and closes the opening 1100 through a forward and backward movement and a lifting and lowering movement with respect to the opening 1100. The cover unit 2000 includes an arm 2200 coupled to the forward and backward driving unit 4000 and a cover member 2100 connected to an end of the arm 2200.

The arm 2200 may have a shape extending in one direction. More specifically, the arm 2200 may have a shape extending in a direction in which the first housing 8100*a* and the container 1000 are arranged. In other words, the arm 2200 may have a shape extending in a direction in which the forward and backward driving unit 4000 and the opening 1100 are arranged. In other words, the arm 2200 may have a shape extending in the longitudinal direction (X-axis direction) of the container 1000. As illustrated in FIG. 2, the arm 2200 may have a plate shape having a predetermined area and thickness.

The arm 2200 may be coupled with the forward and backward driving unit 4000 and moved forward toward the opening 1100 or moved backward toward the opening 1100 by an operation of the forward and backward driving unit 4000. Here, the arm 2200 may be coupled to an upper portion of the forward and backward driving unit 4000. Also, the arm 2200 may be connected to the forward and backward driving unit 4000 in various methods. For example, when the forward and backward driving unit 4000 that will be described later includes a belt having a plurality of protrusions arranged in one direction and grooves between the protrusions, the arm 2200 may be coupled with the belt 4200. That is, a protrusion that is inserted into or engaged with the groove of the belt 4200 may be disposed on a bottom surface of the arm 2200.

However, the arm 2200 is not limited to the above-described exemplary embodiment. The arm 2200 may have all sorts of shapes and units as long as the arm 2200 is coupled with the forward and backward driving unit 4000.

The cover member 2100 that is a unit that closes the opening 1100 is connected to the arm 2200. More specifically, the cover member 2100 is connected to an end (one end) facing the opening 1100 among both ends in an extension direction of the arm 2200. The cover member 2100 has a size enough to cover or close the entire opening 1100. To this end, an uppermost surface of the cover member 2100 may have a size equal to or greater than that of the opening in a vertical direction. Also, a lower portion of the cover member 2100 may be inserted into the container 1000 through the opening. To this end, the cover member 2100 may have a shape having a width that gradually decreases in a direction toward a lower portion of the cover member 2100. In other words, the cover member 2100 may have a shape protruding downward.

Although it is described that the uppermost surface of the cover member 2100 has a size equal to or greater than that of the opening 1100, the exemplary embodiment is not limited thereto. For example, one of the uppermost surface or a lowermost surface of the cover member 2100 may have a size equal to or greater than that of the opening 1100.

The cover member 2100 may be made of a material containing a refractory material. This is to prevent or suppress the temperature drop of the molten material M in the container 1000 when the opening 1100 is closed by the cover member 2100.

As illustrated in FIGS. 2 and 3, the forward and backward driving unit 4000 that is a unit for moving the cover part 2000 forward and backward with respect to the opening 1100 may be disposed above the first housing 8100*a* so as to be disposed at one side of the longitudinal direction (X-axis direction) of the container 1000.

Referring to FIGS. 2 and 3, the forward and backward driving unit 4000 includes: a base 4300 disposed on the lifting and lowering driving unit 5000; a forward and backward driving body 4200 coupled with the arm 2200 above the base 4300 and moved in a direction opposite to the opening 1100; and a forward and backward driving source 4100 disposed on the base 4300 and connected with the forward and backward driving body 4200 to operate the forward and backward driving body 4200. Also, the forward and backward driving unit 4000 may include a connecting member 4400 that connects the forward and backward driving source 4100 and the forward and backward driving body 4200.

The base 4300 may have a plate shape extending in a direction in which the cover unit 2000 extends. In other words, the base 4300 may have a plate shape extending in a direction in which the first housing 8100*a* and the container 1000 are arranged.

The forward and backward driving body 4200 is installed on the base 4300 and coupled with the arm 2200 of the cover unit 2000. As illustrated in FIGS. 2 and 3, the forward and backward driving body 4200 may include a pair of pulleys 4210 arranged in an extension direction of the base 4300 and spaced apart from each other to rotate by an operation of the forward and backward driving source 4100 and a belt 4200 coupled to the pair of pulleys 4210 to surround an outer circumferential surface of the pair of pulleys 4210.

Each of the pair of pulleys 4210 may be a unit including a plurality of protrusions or sawteeth arranged in a circumferential direction of an outer circumferential surface thereof. The belt 4200 may have a loop or ring shape and installed to surround the outer circumferential surfaces of the pair of pulleys 4210. A plurality of protrusions and grooves between the protrusions may be disposed on an inner surface in contact with the outer circumferential surface of the pulley 4210 and an outer surface opposite to the inner surface of the belt 4200. Here, the protrusions disposed on the inner surface of the belt 4200 may be a unit that is inserted into or engaging with the grooves between the protrusions disposed on the outer circumferential surface of the pulley 4210. Also, the protrusions disposed on the outer surface of the belt 4200 may be a unit that is inserted into or engaging with the grooves defined in a bottom surface of the arm 2200.

The forward and backward driving source 4100 that is a unit that allows the pulley 4210 to rotate may be connected to one of the pair of pulleys 4210. Also, the forward and backward driving source 4100 may be a unit that is operated by electric power. For example, the forward and backward driving unit 4000 may be a unit including a motor operated by electric power. As a more specific example, the forward and backward driving source 4100 may be a unit including a direct current motor (DC motor).

Operations of the forward and backward driving body 4200 and the cover unit 2000 by the operation of the forward and backward driving source 4100 when the forward and backward driving source 4100 includes the direct current motor, operations of the forward and backward driving body 4200 and the cover unit 2000 by the operation of the forward and backward driving source 4100 will be briefly described as follows. The DC motor may adjust a rotation direction of the pulley 4210 according to a polarity of supplied power or current. That is, when power is applied by connecting a first terminal of the DC motor to a positive electrode (+) and a second terminal to a negative electrode (−), the pulley 4210 rotates, e.g., clockwise. On the contrary, when power is applied by connecting the first terminal of the DC motor to the negative electrode (−) and the second terminal to the positive electrode (+), the pulley 4210 rotates counterclockwise. Also, the belt 4200 rotates by rotation of the pulley 4210. For example, when the pulley 4210 rotates clockwise, the belt 4200 may rotate clockwise, and conversely, when the pulley rotates counterclockwise, the belt 4200 may rotate counterclockwise. Also, the cover unit 2000 coupled to the belt 4200 is moved by the rotation of the belt 4200. For example, when the belt 4200 rotates clockwise, the cover unit 2000 is moved forward toward the opening 1100 of the container, and when the belt 4200 rotates counterclockwise, the cover unit 2000 is moved backward in a direction opposite to the opening 1100.

The above-described forward and backward driving unit 4000 may be provided in plurality, e.g., in pairs. Also, as illustrated in FIG. 2, the pair of forward and backward driving units 4000 may be arranged in a direction that crosses or is perpendicular to a direction in which the cover unit 2000 is moved forward and backward.

Also, as illustrated in FIG. 2, the forward and backward driving unit 4000 may further include a guide member 4600 that allows the cover unit 2000 to be more stably moved forward and backward. That is, the forward and backward driving unit 4000 may include the guide member 4600 extending in a direction in which the cover unit 2000 extends and installed on the base 4300. The guide member 4600 may be a kind of rail. Also, a moving body (not shown) coupled with the guide member 4600 and sliding along the guide member 4600 may be additionally provided to a bottom surface of the arm 2200.

The lifting and lowering driving unit 5000, as a unit for lifting and lowering the cover unit 2000, may be disposed below the forward and backward driving unit 4000. That is, the lifting and lowering driving unit 5000 may be disposed between the forward and backward driving unit 4000 and the support 8400. This lifting and lowering driving unit 5000 may include a lifting and lowering driving source 5100 disposed on the support 8400 to provide a lifting and lowering driving force and a lifting and lowering driving body 5200 operated to an upper side at which the forward and backward driving unit 4000 is disposed or a lower side that is a side opposite to the forward and backward driving unit 4000 by an operation of the lifting and lowering driving source 5100.

The lifting and lowering driving source 5100 that is a unit for lifting and lowering the lifting and lowering driving body 5200 may be operated by electric power. The lifting and lowering driving source 5100 may include all sorts of units as long as the units lift and lower the lifting and lowering driving body 5200. For example, the lifting and lowering driving source 5100 may include a motor operated by electric power.

The support unit 3000 is a unit that prevents the cover unit 2000 from being deflected due to own weight. That is, the support unit 3000 is a unit that prevents the cover unit 2000 that is moved forward to be away from the forward and backward driving unit 4000 from being tilted to one side. More specifically, the support unit 3000 is provided to prevent the cover unit 2000 from being deflected downward when the cover unit 2000 is moved forward as illustrated in FIGS. 3 and 4 or moved backward as illustrated in FIGS. 5 and 6 or when the cover unit 2000 is lowered as in FIG. 5 in a state in which the cover member 2100 faces the opening as in FIG. 4.

The support unit 3000 may be installed at a side portion of the first housing 8100*a* as illustrated in FIGS. 2 and 3. That is, the support unit 3000 may be disposed in a space between the side portion of the first housing 8100*a* and the container 1000. Also, the support unit 3000 may be installed to be inclined upward from the first housing 8100*a* toward the cover unit 2000 or the opening 1100. Accordingly, when the support unit 3000 is lifted and lowered, the support unit 3000 may not be interfered with the forward and backward driving unit 4000, the lifting and lowering driving unit 5000, and the container 1000.

Referring to FIGS. 2 and 3, the support unit 3000 includes: a support 3200 extending from a lower side of the cover unit 2000 toward the cover unit 2000; a rotating body 3300 installed at one end of the support 3200 to rotate along a forward or backward movement of the cover unit 2000; and a support driving source 3100 that lifts or lowers the support 3200.

The support 3200 may have a bar shape extending in one direction. The rotating body 3300 may be connected to the support 3200. The rotating body 3300 may be connected to one end facing the opening, and the first housing 8100*a* may be connected to the other end that is an opposite end among both ends in an extension direction of the support 3200. Here, since the base 4300, the lifting and lowering driving unit 5000, and the forward and backward driving unit 4000 are installed on the first housing 8100*a*, the other end of the support 3200 may be connected to the side portion of the first housing 8100*a*.

Also, the support 3200 may be inclined upward from the side portion of the first housing 8100*a* toward the opening or cover unit 2000. Accordingly, a height of one end of the support 3200, which is connected to the rotating body 3300, may be greater than that of the other end of the support 3200, which is connected to the first housing 8100*a*.

The rotating body 3300 is installed at one end of the support 3200 to rotate by a force that moves the cover unit 2000 when the rotating body 3300 comes into contact with the cover unit 2000 moving forward and backward. This rotating body 3300 may be a wheel or a roll.

The feature of installing the rotating body 3300 on one end of the support 3200 is to prevent the support 3000 from interfered with the movement of the cover unit 2000. More specifically, in order to prevent the cover unit 2000 from being deflected due to own weight when moving forward and backward, the support unit 3000 is brought into contact with a lower portion of the cover unit 2000 as illustrated in FIGS. 4 and 5, specifically, the rotating body 3300, to support the cover unit 2000. That is, when the cover unit 2000 is moved forward and backward, the rotating body 3300 rotates due to a force of the cover unit 2000 moving forward and backward. Thus, although the rotating body 3300 contacts and supports the cover unit 2000, the rotating body 3300 does not interfere with the forward and backward movement of the cover unit 2000.

However, when the rotating body 3300 is not provided at one end of the support 3200 and the support 3200 is supported by directly contacting the lower portion of the cover unit 2000, the cover unit 2000 may not be smoothly moved by the support 3200. That is, the support 3200 may interfere with the movement of the cover unit 2000. Thus, by installing the rotating body 3300 at one end of the support 3200, the cover unit 2000 may be supported without being deflected and without interfering with the forward and backward movement of the support unit 3000.

The support driving source 3100 is a unit for lifting and lowering the support 3200. The feature of lifting and lowering the inclined support 3200 represents an operation of lifting or lowering a height of one end connected with the rotating body 3300. Also, as the support 3200 is installed to be inclined upward toward the opening, when the support 3200 is lifted, one end of the support 3200 is moved closer to the opening, and when the support 3200 is lowered, the one end is moved away from the opening. Accordingly, the lifting and lowering operation of the support 3200 may be a feature of moving forward toward the opening or moving backward toward a side opposite to the opening. In other words, the support 3200 is moved forward and backward in an inclined direction.

The support height adjustment unit 6000 is a unit for lifting and lowering the entire support unit 3000. That is, as illustrated in FIGS. 4 and 6, the support height adjustment unit 6000 lifts and lowers the entire support unit 3000. The support height adjustment unit 6000 may be installed on a side portion of the first housing 8100*a* as illustrated in FIG. 3, and the other end of the support unit 3000 may be connected to the support height adjustment unit 6000.

The support height adjustment unit 6000 may include: a guide member 6100 extending in the vertical direction and disposed on the side portion of the first housing 8100*a*; a moving block 6200 mounted to the other end of the support unit 3000 and coupled to the guide member 6100 to slide along the guide member 6100; and a height adjustment driving source 6300 operating the moving block 6200. According to the support height adjustment unit 6000, the moving block 6200 is lifted or lowered along the guide member 6100 by an operation of the height adjustment driving source 6300. Here, the support unit 3000 connected to the moving block 6200 is lifted or lowered together with the moving block 6200.

Each of the above-described support driving source 3100 and height adjustment driving source 6300 may be a unit operated by electric power. For example, each of the support driving source 3100 and the height adjustment driving source 6300 may be a unit including a motor that rotates by electric power and a moving member that is moved linearly according to a rotation of the motor and moved forward or backward depending on a rotation direction of the motor. As a more specific example, each of the support drive source 3100 and the height adjustment driving source 6300 may include an LM guide.

Each of the support driving source 3100 and the height adjustment driving source 6300 is not limited to the above-described exemplary embodiment. Each of the support driving source 3100 and the height adjustment driving source 6300 may include all sorts of units capable of lifting or lowering each of the support 3200 and the moving block 6200 by electric power.

The feature of lifting and lowering the entire support unit 3000 by using the support height adjustment unit 6000 is to support the cover unit 2000 even when lifting and lowering the cover unit 2000 without interfering the lifting and lowering of the cover unit 2000. For example, when the cover unit 2000 is lowered as illustrated in FIG. 5 to close the opening by the cover member 2100, the support unit 3000 is also lowered. Accordingly, the support unit 3000 may not interfere with a downward movement of the cover unit 2000. Also, here, the support unit 3000 is lowered while maintaining a state in which the support unit 3000 is in contact with or supported by the arm of the cover unit 2000 instead of being separated from the arm. This may be achieved by lifting or lowering the support unit 3200 using the support driving source 3100 when lowering the entire support unit 3000. In other words, this may be achieved by moving the support 3200 forward or backward toward the cover unit 2000 or the opening 1100. Accordingly, the support unit 3000 may support the cover unit 2000 to prevent being deflected and may not interfere with the downward movement of the cover unit 2000.

The power supply unit 7200 is a unit that provides power to each of the forward and backward driving source 4100, the lifting and lowering driving source 5100, the support driving source 3100, and the height adjustment driving source 6300. The power supply unit 7200 may be a rechargeable battery capable of charging power. In addition, the power supply unit 7200 may be mounted on the molten material transport apparatus and installed, for example, in the first housing 8100*a*. Also, the power supply unit 7200 may be connected to the control unit 7100 that will be described later.

Although the power supply unit 7200 is described to include a rechargeable battery, the exemplary embodiment is not limited thereto. For example, the power supply unit 7200 may include a disposable battery. When the power supply unit 7200 includes the disposable battery, the battery may be replaced periodically.

As the power unit 7200 is installed inside the first housing 8100*a* and mounted on the melt transport apparatus, the cover unit 2000 may be moved forward and backward and lifted and lowered when necessary using its own power without connecting an external power source. That is, when the opening or closing of the opening 1100 is necessary, the opening 1100 may be opened or closed by the cover member 2100 using electric power that uses the mounted power supply unit 7200 without moving the molten material transport apparatus to a position at which external power is disposed.

The control unit 7100 may be installed in the first housing 8100*a*, more specifically, inside the first housing 8100*a*. Also, the control unit 7100 may be operated by a command signal input from the outside to control each of the forward and backward driving unit 4000, the lifting and lowering driving unit 5000, the support unit 3000, and the support height adjustment unit 6000.

This control unit 7100 may include a forward and backward control unit 7110 that controls the operation of the forward and backward driving unit 4000, a lifting and lowering control unit 7120 that controls the operation of the lifting and lowering driving unit 5000, a support unit 3000, and support height adjustment unit 6000.

The forward and backward control unit 7110 controls an operation of the forward and backward driving source 4100. That is, the forward and backward control unit 7110 controls the forward and backward driving source 4100 to adjust a rotation direction of the pulley 4210 and whether the pulley 4210 rotates of the forward and backward driving body 4200. Here, the forward and backward control unit 7110 may be operated according to a command signal input from the outside to control the forward and backward driving source 4100. That is, when one of a forward movement command signal, a forward movement stop command signal, a backward movement command signal, and a backward movement stop command signal input from the remote controller R operated by the worker H is sent to the forward and backward control unit 7110, the forward and backward control unit 7110 controls the operation of the forward and backward driving source 4100 according to the input signal.

Accordingly, the forward and backward driving body, that is, the pulley 4210, connected to the forward and backward driving source 4100 is adjusted to rotate or not rotate, and the rotation direction is adjusted.

The lifting and lowering control unit 7120 controls the operation of the lifting and lowering driving source 5100. In other words, the lifting and lowering control unit 7120 controls the lifting and lowering driving source 5100 to adjust whether the lifting and lowering driving body 5200 is operated and a movement direction (i.e., upward or downward movement) of the lifting and lowering driving body 5200. Also, the lifting and lowering control unit 7120 may be operated according to the command signal input from the outside. That is, when one of a lifting command signal, a lifting stop command signal, a lowering command signal, and a lowering stop command signal is input from the remote controller R, the lifting and lowering control unit 7120 controls the operation of the lifting and lowering driving source 5100 according to the input command signal. Accordingly, the lifting and lowering driving body 5200 connected to the lifting and lowering driving source 5100 may be lifted or lowered, or the lifting and lowering operation may be stopped.

The support control unit 7130 controls operations of the support driving source 3100 and the height adjustment driving source 6300 of the support unit 3000. Also, the support control unit 7130 controls the support driving source 3100 and the height adjustment driving source 6300 according to the command signal input from the outside.

When the support driving source 3100 is explained first, when one of the lifting command signal, the lifting stop command signal, the lowering command signal, and the lowering stop command signal is input from the remote controller R to the support control unit 7130, the support control unit 7130 controls an operation of the support driving source 3100 according to the input signal. That is, the support control unit 7130 controls the operation of the support driving source 3100 according to the input signal, so that the support 3200 is lifted or lowered, or the lifting and lowering operation is stopped.

In addition, when one of the lifting command signal, the lifting stop command signal, the lowering command signal, and the lowering stop command signal with respect to the entire support unit 3000 is input from the remote controller R to the support control unit 7130, the support control unit 7130 controls the operation of the height adjustment drive source 6300 according to the input signal. Accordingly, the support unit 3000 connected to the support height adjustment unit 6000 may be lifted or lowered, or the lifting and lowering operation may be stopped.

As described above, each of the forward and backward control unit 7110, the lifting and lowering control unit 7120, and the support control unit 7130 controls power input from the power unit 7200 to be output or not output to the driving source connected with each component.

That is, the forward and backward control unit 7110 controls the power input from the power unit 7200 to be output (on) or not output (off) to the forward and backward driving source 4100, and the lifting and lowering control unit 7120 controls the power input from the power supply unit 7200 to be output (on) or not output (off) to the lifting and lowering driving source 5100. Here, each of the forward and backward control unit 7110 and the lifting and lowering control unit 7120 may or may not output power depending on the input command signal.

Also, the support control unit 7130 controls the power input from the power supply unit 7200 to be output (on) or not output (off) to each of the support driving source and the height adjustment driving source 6300. Here, the support control unit 7130 may or may not output power according to the command signal for the support 3200 or the support unit 3000.

It is described above that the worker wirelessly transmits the command signal to the forward and backward control unit 7110, the lifting and lowering control unit 7120, and the support control unit 7130 by using the remote controller R to control the operations of the forward and backward driving unit 4000, the lifting and lowering driving unit 5000, the support unit 3000, and the support height adjustment unit 6000. However, the exemplary embodiment is not limited to the method of controlling the operation of each of the forward and backward control unit 7110, the lifting and lowering control unit 7120, and the support control unit 7130 or inputting the command signal.

For example, an operation button (not shown) connected to each of the forward and backward control unit 7110, the lifting and lowering control unit 7120, and the support control unit 7130 may be installed outside the first housing 8100*a*. Also, by operating the operation buttons, the worker may control each of the forward and backward control unit 7110, the lifting and lowering control unit 7120, and the support control unit 7130. That is, the command signal may be input to each of the forward and backward control unit 7110, the lifting and lowering control unit 7120, and the support control unit 7130 by using the operation buttons. Accordingly, each of the forward and backward control unit 7110, the lifting and lowering control unit 7120, and the support control unit 7130 is operated according to the input command signal to control the operation of each of the forward and backward driving source 4100, the lifting and lowering driving source 5100, the support driving source 3100, and the height adjustment driving source 6300.

As another example, an operation handle (not shown) that applies a physical force to each of the forward and backward driving source 4100, the lifting and lowering driving source 5100, the support driving source 3100, and the height adjustment driving source 6300 may be provided. That is, the operation handle connected to each of the forward and backward driving source 4100, the lifting and lowering driving source 5100, the support driving source 3100, and the height adjustment driving source 6300 may be installed outside the first housing 8100*a*. The operation handle is provided so that the worker directly applies a force. The operation handle is provided so that the worker H gets off from the molten material transport apparatus and directly operates the operation handle in a situation when at least one of the forward and backward control unit 7110, the lifting and lowering control unit 7120, and the support control unit 7130 is malfunctioned.

Hereinafter, the operation of the molten material transport apparatus in accordance with an exemplary embodiment will be described with reference to FIGS. 1 to 6. Here, the molten iron drawn from a blast furnace as the molten material M will be described as an example. Also, a state, in which the molten iron drawn from the blast furnace is charged into the container 1000, then the opening 1100 is closed by the cover member 2100, and then the molten material transport apparatus starts moving, will be described as an example.

When the molten material transport apparatus is moved to arrive at a position at which the opening 1100 is required to be opened, the molten material transport apparatus is stopped. Here, the position at which the opening 1100 is required to be opened may be, for example, a position at which a heating agent is input into the molten iron in the container 1000.

When the molten material transport apparatus arrives at a heating agent input position and stops moving, the cover unit 2000 is moved to open the opening 1100. A method of opening the opening 1100 will be described again later. When the opening 1100 is opened, the heating agent is input into the container 1000.

When the inputting of the heating agent is completed, the opening 1100 is closed again. To this end, the power input from the power supply unit 7200 through the forward and backward control unit 7110 is output to the forward and backward driving source 4100 to operate the forward and backward driving source 4100. Here, the forward and backward control unit 7110 controls an operation of the forward and backward driving source 4100 so that the pulley 4210 rotates clockwise. Accordingly, the pulley 4210 and the belt 4200 rotate clockwise, and thus the cover unit 2000 is moved forward toward the opening 1100 as illustrated in FIGS. 3 to 4.

As described above, when the cover unit 2000 is moved forward, the support unit 3000 supports the cover unit 2000 so that the cover unit 2000 is not deflected. To this end, firstly, the entire support unit 3000 is lifted by using the support height adjustment unit 6000. Thereafter, as illustrated in FIG. 4, the support driving source 3100 is operated to lift the support unit 3200 so that the rotating body 3300 of the support unit 3000 contacts a bottom surface of the arm 2200 of the cover unit 2000. As described above, when the rotating body 3300 contacts the bottom surface of the arm 2200, the support unit 3000 supports the cover unit 2000 (first support process).

Although it is described that the entire support unit 3000 is lifted by using the support height adjustment unit 6000, and then the support 3200 is lifted, the exemplary embodiment is not limited thereto. For example, the process may be performed in any order and may be performed simultaneously as long as the rotating body 3300 supports the bottom surface of the arm 2200.

When the cover unit 2000 is supported by allowing the rotating body 3300 of the support unit 3000 to contact the cover unit 2000, an area other than the cover member 2100, that is, the arm 2200, may be supported as illustrated in FIG. 4. This is because the cover member 2100 is made of a refractory material that has an excellent heat resistance but is relatively vulnerable to an impact. Thus, when the cover unit 2000 begins to move forward, the cover unit 2000 may not be supported by using the support unit 3000. That is, at the beginning of the forward movement, the rotating body 3300 and the arm 2200 of the support 3200 may be spaced apart from each other. Then, after the cover unit 2000 starts to move forward and the cover member 2100 passes the rotating body 3300, the rotating body 3300 of the support unit 3000 is brought into contact with the arm 2200 to move the cover part 2000.

Thereafter, when the forward and backward driving source 4100 continues to be operated, the cover unit 2000 continues to be moved forward by an operation of the forward and backward driving body 4200. That is, as illustrated in FIGS. 3 and 4, the cover member 2100 is gradually moved forward toward the opening 1100. Here, since the support unit 3000 supports the arm 2200 at a lower portion thereof, the cover unit 2000 may be prevented from being deflected by the own weight. Also, since the rotating body 3300 rotates due to a force of the cover unit 2000 moving forward, the support unit 3000 may support the cover unit 2000 without interfering with the movement of the cover unit 2000.

During this forward movement, when the cover member 2100 faces the opening as illustrated in FIG. 4, the forward and backward control unit 7110 stops the operation of the forward and backward driving source 4100. Accordingly, the operation of the forward and backward driving body 4200 is stopped, and the forward movement of the cover unit 2000 is stopped.

Thereafter, the lifting and lowering driving source 5100 is operated by using the lifting and lowering control unit 7120 to lower the cover unit 2000 as illustrated in FIG. 5. Here, the cover member 2100 is lowered so as to be seated on an upper wall of the container 1000 around the opening 1100. Also, the cover unit 2000 is lowered so that at least the lowermost surface of the cover member 2100 is inserted into the container 1000 through the opening. Accordingly, the opening 1100 of the container 1000 is closed by the cover member 2100 as illustrated in FIG. 5.

When the cover unit 2000 is lowered, the support unit 3000 is also lowered as illustrated in FIG. 5. This is to prevent the support unit 3000 from interfering with the lowering of the cover unit 2000. That is, when lowering the cover part 2000, when a height of the support unit 3000 is fixed while supporting the cover unit 2000, the cover unit 2000 may not be lowered. Thus, when the cover unit 2000 is lowered, the support unit 3000 is also lowered.

Also, when the cover unit 2000 and the support unit 3000 are lowered to close the opening 1100, a state in which the support unit supports the cover unit 2000 is maintained (second support process). That is, the rotating body 3300 is maintained in a state of contacting the arm 2200 of the cover unit 2000. This may be adjusted by operating the support driving source 3100 to lift the support unit 3200 toward the cover unit 2000 or lower the support unit 3200 toward the opposite side when the support unit 3000 is lowered.

On the other hand, when the arm 2200 of the cover unit 2000 extends long in one direction, and the cover member 2100 faces the opening 1100, most of the arm 2200 is disposed outside the forward and backward driving unit 4000. When the cover unit 2000 is not supported in this state, the cover unit 2000 may be deflected downward. That is, the cover unit 2000 may be inclined so that a height thereof gradually decreases in a direction toward the cover member 2100. Also, the cover member 2100 may also be inclined. In this case, when the cover member 2100 is lowered and the cover member 2100 is seated on the opening 1100, a gap is formed between the opening 1100 and the upper wall of the container 1000 around the opening 1100. Accordingly, a portion of the opening 1100 may be exposed, which may cause a problem in that the opening 1100 may not be completely closed.

However, when the cover unit 2000 is continued to be supported by using the support unit 3000 while the cover unit 2000 is lowered, when the cover part 2000 is lowered, the cover unit 2000 may be prevented from being deflected. That is, the cover unit 2000 may be prevented from being deflected to one side. Accordingly, the cover member 2100 may be prevented from being deflected, and thus at least a portion of the opening 1100 may be prevented from being exposed. Thus, the entire opening 1100 may be closed by the cover member 2100.

When the opening 1100 is closed, the molten material transport apparatus is transported again. Then, when the molten material transport apparatus arrives at a position at which the opening 1100 is required to be opened, such as the desulfurization agent input position, while the molten material transport apparatus is moved, the opening 1100 is opened. To this end, the opening 1100 is opened by moving the cover unit 2000 in contrast to the closing operation of the opening 1100 described above. That is, firstly, the cover unit 2000 is lifted by using the lifting and lowering driving unit 5000. Accordingly, the cover member 2100 is spaced upward from the container 1000, and the opening 1100 is opened. Then, when the cover unit 2000 is lifted, the support unit 3000 may support the cover unit 2000.

Thereafter, as illustrated in FIG. 6, the forward and backward driving unit 4000 is operated to move the cover unit 2000 backward. Here, the cover unit 2000 is moved backward so that the cover member 2100 is positioned at one side of the opening 1100 rather than facing the opening 1100. Accordingly, the opening of the container 1000 is completely opened. When the opening 1100 is opened, a material such as the heating agent is input into the container 1000. When the inputting of the material is completed, the cover unit 2000 is moved forward and lowered again to close the opening.

There may be a plurality of positions at which the opening 1100 is required to be opened along a path by which the molten material transport apparatus arrives at the final destination. Accordingly, the above-described opening and closing operations of the opening 1100 may be performed a plurality of times.

Thereafter, when the molten material transport apparatus arrives at the final destination, the molten material transport apparatus stops moving. Here, the final destination may be a steel manufacturing plant that controls contents of phosphorus (P), sulfur (S), and carbon (C) in the molten iron. Then, the molten iron is discharged from the molten material transport apparatus to the outside. That is, the container 1000 rotates by using the first and second rotation driving units 8200*a* and 8200*b* to lower a height of the opening 1100. Accordingly, the molten iron is discharged through the opening 1100 of the container 1000, and the discharged molten iron is charged into another container, such as a ladle, disposed below the container 1000.

Although descriptions are omitted above, each of the forward and backward control unit 7110, the lifting and lowering control unit 7120, and the support control unit 7130 may be operated by the command signal input from the remote controller R operated by the operator H to control the forward and backward driving unit 4000, the lifting and lowering unit 5000, the support unit 3000, and the support height adjustment unit 6000.

Figure 7:
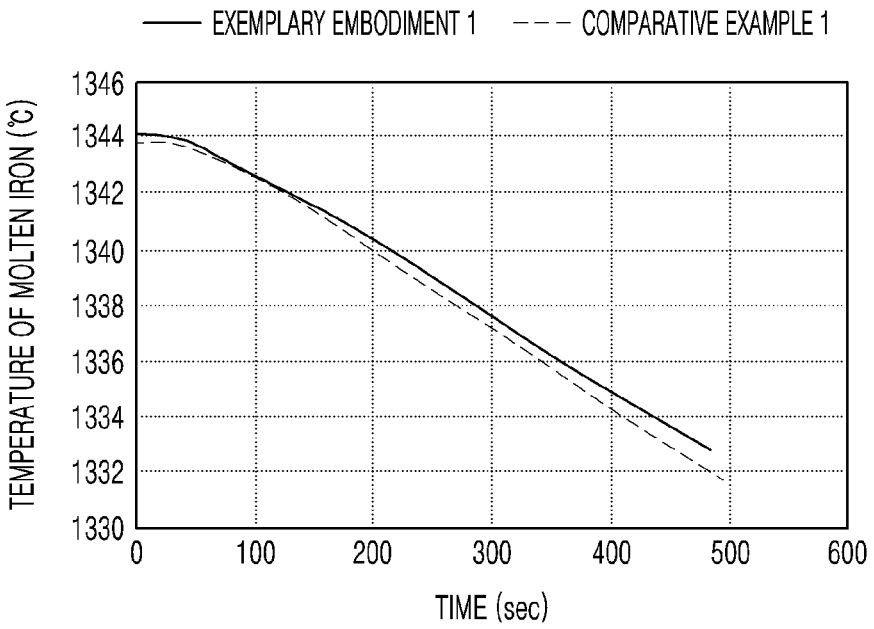
FIG. 7 is a graph representing a temperature variation as time elapses when molten iron is moved by molten material transport apparatuses in accordance with an exemplary embodiment and a comparative example.

FIG. 7 is a graph representing a temperature variation of molten iron over time when molten iron is moved to the molten material transport apparatus in accordance with an exemplary embodiment and a comparative example. Table 1 shows a temperature drop per second, per minute, and per hour when molten iron is moved to the molten material transport apparatus in accordance with an exemplary embodiment and a comparative example.

Here, the molten material transport apparatus in accordance with the comparative example does not have a cover unit and is moved without covering the opening.

Referring to FIG. 7, a temperature of the exemplary embodiment is greater than that of the comparative example in an entire time section. Also, after 200 seconds elapses, a temperature drop rate of the exemplary embodiment is slower than that of the comparative example.

TABLE 1

| | Exemplary embodiment | Comparative example |
|---|---|---|
| Temperature drop per second (° C./sec) | 0.02571 | 0.02771 |
| Temperature drop per minute (° C./min) | 1.5428 | 1.6628 |
| Temperature drop per hour (° C./hour) | 92.5714 | 99.7714 |

Also, referring to Table 1, when the temperature drop rate is compared per second, per minute, and per hour, the exemplary embodiment is lower than the comparative example.

From this, it may be known that when the temperature drop of the molten material is effectively suppressed when the molten material is moved by using the molten material transport apparatus in accordance with an exemplary embodiment.

As described above, in the exemplary embodiment, the opening 1100 is opened and closed by moving the cover member 2100 horizontally, that is, moving the cover member 2100 forward and backward. That is, the opening 1100 may be opened and closed by an operation of moving the cover member 2100 backward to one side of the opening 1100 or forward toward the opening 1100 while minimizing a height of lifting or lowering the cover member 2100 to an upper side of the opening 1100. Thus, the opening 1100 of the container 1000 may be easily opened and closed in a limited space.

Also, when the cover unit 2000 is moved to open and close the opening 1100, the cover unit 2000 is supported by using the support unit 3000, thereby preventing the cover unit 2000 from being inclined. That is, the cover unit 2000 may be prevented from being deflected to one side. Accordingly, the forward and backward movement of the cover unit 2000 may be easily performed.

Also, this may prevent the cover member 2100 closing the opening 1100 from being inclined. Accordingly, a gap between the cover member 2100 and the container 1000 may be prevented, and thus at least a portion of the opening 1100 may be prevented from being exposed to the outside. Thus, when the opening 1100 is closed by the cover member 2100, the temperature drop of the molten material in the container 1000 may be minimized.

Also, in an exemplary embodiment, the molten material transport apparatus moves with the rechargeable power supply unit 7200 mounted. Thus, the opening 1100 may be opened and closed without being connected to the external power source, and the opening 1100 may be freely opened and closed when necessary.

INDUSTRIAL APPLICABILITY

In accordance with the exemplary embodiment, the opening of the container may be easily opened and closed in a limited space.

Also, the cover unit may be prevented from being deflected or inclined when the opening is opened and closed by moving the cover unit. Thus, the cover unit may be easily moved, and at least a portion of the opening may be prevented from being exposed to the outside. Thus, the temperature drop of the contents of the container may be prevented or suppressed.

Also, the opening may be opened and closed without being connected to the external power source, and the opening may be freely opened and closed when necessary.

What is claimed is:

1. A molten material transport apparatus comprising:

a container having an internal space in which the molten material is accommodated and an opening through which the molten material enters and exits;

a cover unit having a cover member configured to close the opening and to be moved forward and backward with respect to the opening;

a support unit having a rotating body disposed below the cover unit and moved forward and backward with respect to the cover unit to contact the cover unit; and a forward and backward driving unit coupled to a lower portion of the cover unit at one side of the container to move the cover unit forward and backward, wherein the support unit is disposed between the forward and backward driving unit and the container and inclined upward so that a distance to the opening gradually decreases in a direction toward the rotating body.

2. The molten material transport apparatus of claim 1, wherein the support unit comprises:

a support having one end facing the cover unit, which is connected to the rotating body, and being inclined upward so that a distance to the opening gradually decreases in a direction toward the one end; and a support driving source connected to the other end of the support to move the support forward and backward with respect to the cover unit.

3. The molten material transport apparatus of claim 1, further comprising a support height adjustment unit connected with the support unit to lift and lower the support unit.

4. The molten material transport apparatus of claim 3, further comprising:

a lifting and lowering driving unit connected to a lower portion of the forward and backward driving unit to lift and lower the forward and backward driving unit; and first and second housings connected to both ends in a longitudinal direction of the container, respectively, wherein the forward and backward driving unit and the lifting and lowering driving unit are disposed on an upper portion of the first housing, and the support unit and the support height adjustment unit are disposed on a side portion of the first housing.

5. The molten material transport apparatus of claim 4, further comprising a power supply unit disposed on the first housing to provide power to each of the forward and backward driving unit, the lifting and lowering driving unit, the support unit, and the support height adjustment unit, wherein the power supply unit comprises a battery.

6. The molten material transport apparatus of claim 4, further comprising a control unit configured to control an operation of each of the forward and backward driving unit, the lifting and lowering driving unit, the support unit, and the support height adjustment unit by wirelessly receiving a command signal input from the outside.

7. The molten material transport apparatus of claim 4, further comprising:

a control unit disposed on the first housing to control an operation of each of the forward and backward driving unit, the lifting and lowering driving unit, the support unit, and the support height adjustment unit; and an operation button disposed on the first housing to transmit a command signal to the control unit.

8. The molten material transport apparatus of claim 4, further comprising an operation handle disposed on the first housing to control an operation of each of the forward and backward driving unit, the lifting and lowering driving unit, the support unit, and the support height adjustment unit.

9. A method for transporting a molten material, the method comprising:

transporting a molten material transport apparatus in which the molten material is accommodated in a container; and opening and closing an opening of the container, wherein the opening and closing of the opening comprises:

moving a cover unit forward or backward with respect to the opening; and primarily supporting the cover unit that is moved forward or backward at a lower side of the cover unit wherein the opening and closing of the opening comprises:

lifting or lowering the cover unit after the moving of the cover unit forward or backward; and secondarily supporting the cover unit that is lifted or lowered at the lower side of the cover unit, wherein the primarily supporting and secondarily supporting comprise allowing a rotating body disposed below the cover unit to contact the cover unit, and the primarily supporting comprises allowing the rotating body to rotate by a force of the cover unit that is moved forward or backward.

10. The method of claim 9, wherein the allowing of the rotating body to contact the cover unit comprises moving the rotating body forward or backward with respect to the cover unit, and the moving of the rotating body forward or backward with respect to the cover unit comprises moving the rotating body forward or backward in an inclined manner so that a distance spaced apart from the opening gradually decreases as a height of the rotating body increases.

11. The method of claim 9, wherein the allowing of the rotating body to contact the cover unit comprises allowing the rotating body to contact an area except for an area facing the opening when a portion of the cover unit faces the opening to close the opening.

12. The method of claim 9, wherein each of the moving of the rotating body forward or backward, the primarily supporting and secondarily supporting, and the lifting and lowering is operated by using power.

13. The method of claim 9, wherein each of the moving of the rotating body forward or backward, the primarily supporting and secondarily supporting, and the lifting and lowering comprises generating a command signal through a remote controller provided separately from the molten material transport apparatus and connected wirelessly to the cover unit and the rotating body.

* * * * *